US005990621A

United States Patent [19]

Sobieradzki

[11] Patent Number: 5,990,621

[45] Date of Patent: Nov. 23, 1999

[54] ELECTRON BEAM TUBES INCLUDING CERAMIC MATERIAL FOR REALIZING RF CHOKES

[75] Inventor: Edward Stanislaw Sobieradzki, Chelmsford, United Kingdom

[73] Assignee: EEV Limited, United Kingdom

[21] Appl. No.: 08/891,829

[22] Filed: Jul. 14, 1997

Related U.S. Application Data

[63] Continuation of application No. 08/541,958, Oct. 10, 1995, abandoned.

[30] Foreign Application Priority Data

Oct. 12, 1994 [GB] United Kingdom ..... 9420606
Oct. 25, 1994 [GB] United Kingdom ..... 9421440

[51] Int. Cl.[6] ..... H01J 25/04

[52] U.S. Cl. ..... 315/5; 315/5.37; 315/5.39; 330/45

[58] Field of Search ..... 315/4, 5, 5.33, 315/5.37, 5.39; 330/44, 45

[56] References Cited

U.S. PATENT DOCUMENTS 2,425,748 8/1947 Llewellyn ..... 330/45 X
5,239,272 8/1993 Bohlen et al. ..... 315/5 X
5,536,992 7/1996 Crompton ..... 315/4
5,548,245 8/1996 Bohlen et al. ..... 330/45

FOREIGN PATENT DOCUMENTS 0 632 481 1/1995 European Pat. Off. .
6 652 580 5/1995 European Pat. Off. .
41 07 552 9/1991 Germany .
2 243 943 11/1991 United Kingdom .
2 244 173 11/1991 United Kingdom .
2 277 193 10/1994 United Kingdom .
2277194 10/1994 United Kingdom .
2278012 11/1994 United Kingdom .

*Primary Examiner*—Benny T. Lee
*Attorney, Agent, or Firm*—Venable; Robert J. Frank; Robert Kinberg

[57] ABSTRACT

A linear electron beam tube such as an IOT includes an input cavity formed from an inner body portion and an outer body portion which are joined together by a ceramic cylinder. The input cavity surrounds an electron gun and permits electrical connection to be made to the cathode and grid via parts of the inner body portion and. Metallization layers in conjunction with the intervening ceramic material of the cylinder define rf chokes. The construction enables high voltage parts of the arrangement to be insulated from the low voltage outer body portion whilst presenting a low leakage path for r.f. energy within the

20 Claims, 2 Drawing Sheets

ELECTRON BEAM TUBES INCLUDING CERAMIC MATERIAL FOR REALIZING RF CHOKES

This application is a continuation of application Ser. No. 08.541,958 filed Oct. 10, 1995, now abandoned.

FIELD OF THE INVENTION

This invention relates to electron beam tubes and more particularly to input resonator cavities of such tubes at which high frequency energy is applied.

The present invention is particularly applicable to inductive output tetrode devices (hereinafter referred to as "IOT's") such as those referred to by the trade name Klystrode (Registered Trade Mark, Varian Associates Inc.)

BACKGROUND OF THE INVENTION

An IOT device includes an electron gun arranged to produce a linear electron beam and an input resonant cavity at which an r.f. signal to be amplified is applied to produce modulation of the beam at a grid of the electron gun. The resultant interaction between the r.f. energy and the electron beam causes amplification of the high frequency signal which is then extracted from an output resonant cavity.

During operation of the tube, electrodes of the electron gun must be operated at relatively high voltages, of the order of tens of kilovolts, and this may cause problems, especially as the input cavity may form an external part of the IOT and therefore would be handled during normal usage of the device. The present invention arose from an attempt to provide an improved IOT input cavity arrangement but is also applicable to other types of linear electron beam devices having input resonant cavities.

SUMMARY OF THE INVENTION

According to the invention, there is provided a linear electron beam tube comprising:

an input cavity which is substantially cylindrical about a longitudinal axis and arranged to receive, in use, a high frequency signal to be amplified;

an electron gun arranged to produce an electron beam in a substantially longitudinal direction; and an output cavity from which the amplified high frequency signal is extracted; wherein the input cavity substantially surrounds the electron gun and comprises an inner body portion electrically connected to part of the electron gun and an outer body portion electrically insulated from the inner body portion, the inner body portion being maintained at a relatively high voltage compared to that of the outer body portion, and wherein the inner and outer body portions each include an axially extensive metallic portion substantially coextensive in an axial direction with ceramic material being located between the metallic portions.

By "high voltage" it is meant that the voltage is on the order of tens of kilovolts.

The use of the invention enables parts of a linear electron beam tube which operate at relatively high voltages to be located such that they are not readily accessible during normal operation of the tube. In addition, the arrangement of the metallic portions of the inner and outer body portions and the ceramic material located between them acts as an rf choke. This enables the two body portions to be separated to achieve the desired electrical isolation between them while permitting the input cavity to be such that there is low rf leakage from it, thereby affording efficient operation.

The use of ceramic material as part of the r.f. choke in accordance with the invention offers a number of important advantages. The ceramic material maintains its shape even at very high temperatures, of the order of 1000° C. or more, and remains rigid at these high temperatures. The ceramic material may be readily machined or otherwise fabricated into the desired shape, which in one particularly advantageous embodiment is substantially cylindrical being located coaxially with the longitudinal axis of the tube. The ceramic provides good voltage hold-off over the range of temperatures encountered during operation. The ceramic material also provides a surface onto which the metallic portions can be fixed. These portions may advantageously comprise metallized regions of the ceramic surface but in some embodiments they may be formed as separate components fixed to the ceramic surface. The ability to metallize the ceramic surface allows high accuracies to be achieved in positioning the metallic portions relative to one another. Also, if for any reason it is necessary to remove or replace the ceramic tube during servicing, metallization of its surfaces enables this to be relatively easily carried out.

The structural integrity offered by the use of the ceramic material allows the tube to undergo thermal cycling without significant distortion of the choke, offering good lifetimes for the tube as a whole.

As the ceramic material maintains its configuration during operation of the tube, even at higher temperatures, it does not require the metallic portions to offer support to hold it in shape. Again, this allows a metallization layer to be used rather than a separate metal component to define the choke, with the consequent advantages in accuracy of the choke dimensions and fabrication as mentioned previously. In a particularly advantageous embodiment of the invention, the ceramic material is extensive in the axial direction beyond the choke. This may be used for example as a shield against arcing in the tube between parts which are at different electrical potentials.

In one advantageous embodiment of the invention, electrically insulating material of a different type covers at least some of the ceramic material. This may be, for example, silicone rubber. This may also be included over at least some of the metallic portions to provide additional shielding. It is supported in position by the ceramic material.

The metallic portions of the r.f. choke extend in substantially the same direction and hence are substantially parallel to each other. This is particularly advantageous as it reduces electrical stresses and therefore the tendency of voltage breakdown to occur between the inner and outer body portions, even at high voltages.

It is preferred that the metallic portions are substantially cylindrical, as this is a symmetrical configuration which is usually desirable in linear electron beam tubes as it gives good electrical characteristics and results in a mechanically robust arrangement.

Preferably, each of the inner and outer body portions includes two metallic portions extensive in an axial direction outwardly from the input cavity, there thus being two pairs of co-extensive metallic portions. Such an arrangement minimizes r.f. losses in the region between the inner and outer body portions. Although the input cavity could alternatively comprise only one such pair, this would tend to result in an r.f. leakage path being present between other parts of the cavity.

It is preferred that the inner body portion comprises two sections which are electrically separate from one another.

Again, this facilitates manufacture and assembly and advantageously also permits different voltages to be applied to different parts of the electron gun via the inner body portion. In one preferred embodiment of the invention, the inner body portion is electrically connected to a cathode and a grid of the electron gun. Where two sections are included, one of them may be physically and electrically connected to the cathode and the other to the grid.

Where two pairs of rf chokes are included in the arrangement, the ceramic material may be present as two separate rings, for example, one ring being interposed between one pair of metallic portions and the other between the other pair. Alternatively, and preferably, the electrically insulating material is a unitary member which is extensive between both pairs of metallic portions Advantageously, the inner and outer body portions are physically joined together by the ceramic material.

Preferably, the outer body portion is at ground potential.

BRIEF DESCRIPTION OF THE DRAWINGS

Some ways in which the invention may be performed are now described by way of example with the reference to the accompanying drawings in which.

DESCRIPTION OF PREFERRED EMBODIMENT

Figure 1:
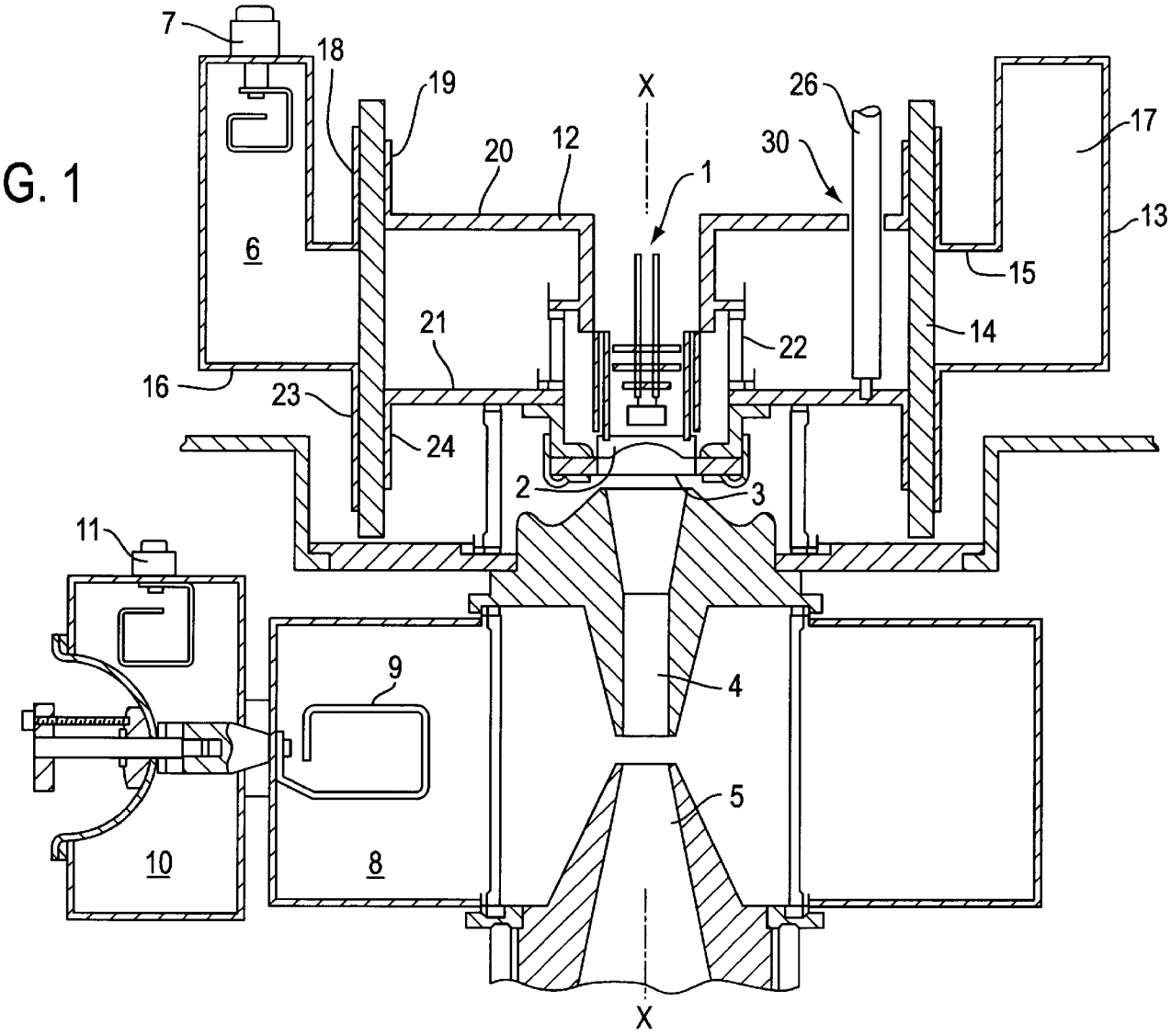
FIG. 1 is a schematic sectional view of an IOT in accordance with the present invention, some parts of which have been omitted for sake of clarity.

With reference to FIG. 1, an IOT comprises an electron gun 1 which includes a cathode 2 and grid 3 arranged to produce an electron beam along the longitudinal axis X—X of the arrangement. The IOT includes drift tubes 4 and 5 via which the electron beam passes before being collected by a collector (not shown). A cylindrical input resonant cavity 6 is arranged coaxially about the electron gun 1 and includes an input coupling 7 at which an r.f. signal to be amplified is applied. An output cavity 8 surrounds the drift tubes 4 and 5 and includes a coupling loop 9 via which an amplified r.f. signal is extracted and coupled into a secondary output cavity 10 and an output coupling 11.

During operation of this device, the cathode 2 and grid 3 are maintained at potentials of the order of 30 kV, the grid 3 being maintained at a dc bias voltage at about 100 volts less than the cathode potential. The input high frequency signal applied at input coupling 7 results in an r.f. voltage of a few hundred volts being produced between the cathode 2 and the grid 3.

The input cavity 6 is defined by an inner body portion 12 and an outer body portion 13 with ceramic material in the form of a cylinder 14 located therebetween, the inner body portion 12 being electrically insulated from the outer body portion 13 by the intervening ceramic material 14. The outer body portion 13 is maintained at substantially ground potential, thus facilitating safe handling of the device, while the inner body portion 12 is maintained at much higher voltages.

The outer body portion includes two annular plates 15 and 16 arranged parallel to one another and transverse to the longitudinal axis X—X with a cylindrical outer section 17. The inner body portion 12 comprises two sections. The first section 20 is mechanically and electrically connected to the cathode 2 and the second section 21 is mechanically and electrically connected to the grid 3. In the embodiment shown, a ceramic cylinder 22 is located between the sections 20 and 21 to give additional mechanical support to the assembly.

The ceramic cylinder 14 provides electrical insulation between the inner body portion 12 and the outer body portion 13 and also forms part of an rf choke means to substantially prevent leakage of high frequency energy from the cavity 6. The plate 15 of the outer body portion 13 is arranged adjacent a metallized layer 18 on the outer surface of the ceramic cylinder 14 extending around it in the circumferential direction. The section 20 of the inner body portion 12 is arranged adjacent the inner surface of the cylinder 14 and also is in contact with metallization 19 extending circumferentially within the cylinder 14. The metallization layers 18 and 19 and the intervening part of the ceramic cylinder 14 together define an rf choke. Similarly, the annular plate 16 of the outer body portion 13 is in contact with metallization 23 and the section 21 with metallization 24 to define a second rf choke. The metallization layer on the outer surface of the ceramic may be longer or shorter in the longitudinal axial direction than the corresponding metallization layer on the inner surface of the cylinder 14.

In other embodiments of the invention, one or more of the metallization layers may be replaced by a separately formed metal cylinder which is located adjacent the ceramic cylinder 14.

A power lead 26 is routed via an unsealed aperture 30 in the section 20 to supply the grid 3 with the appropriate bias voltage, the connection being made via the lead 26 to the section 21. As may be appreciated from FIG. 1, both the first and second rf chokes are located outside the vacuum envelope within which electron gun 1 is disposed, the vacuum envelope being formed in part by section 20 and ceramic cylinder 22 on the left-hand side of longitudinal axis X—X.

Figure 2:
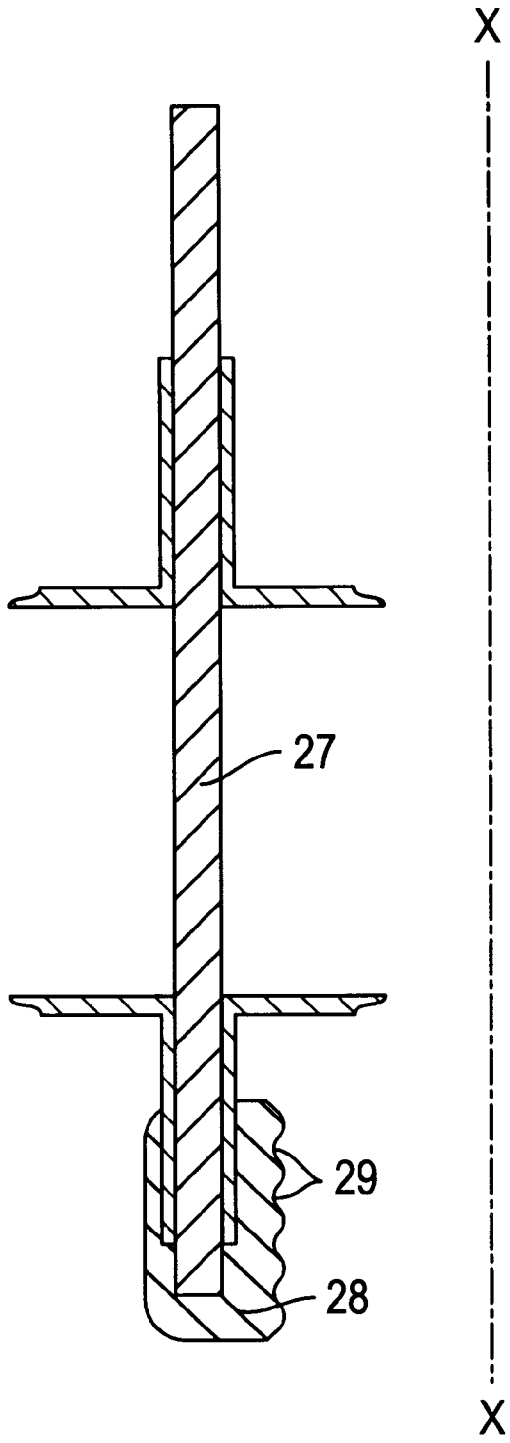
FIG. 2 schematically illustrates part of another IOT in accordance with the invention.

Part of another IOT similar to that of FIG. 1 is shown in FIG. 2 on the left-hand side of longitudinal axis X—X. In this embodiment, a single ceramic cylinder 27 similar to that of the FIG. 1 embodiment is used and again, metallization is laid down on the surfaces to define two rf chokes. At one end of the ceramic cylinder 27, a layer of silicone rubber 28 is arranged to cover the end of the cylinder and its inner and outer surfaces and part of the metallization layers. The inner surface of the silicone rubber 28 includes a plurality of circumferential grooves 29 to improve voltage hold-off ability.

I claim:

1. A linear electron beam tube having a longitudinal axis, comprising:

an input cavity which is substantially cylindrical about the longitudinal axis and including means for applying to said cavity a high frequency signal to be amplified;

an electron gun arranged to produce an electron beam in a direction substantially parallel with the longitudinal axis;

a vacuum envelope within which the electron gun is contained;

means disposed along the electron beam for causing said electron beam and said high frequency signal to interact to produce an amplified high frequency signal; and an output cavity surrounding the electron beam downstream of the input cavity along the electron beam direction and from which said amplified high frequency signal is extracted;

wherein said input cavity substantially surrounds said electron gun and comprises an inner body portion electrically connected to part of the electron gun and an outer body portion electrically insulated from said inner body portion, said inner body portion being maintained at a relatively high voltage compared to that of said outer body portion, the inner and outer body portions each include respective first and second metallic portions extending in the direction of the longitudinal axis, the first metallic portion of the inner body portion being substantially co-extensive with the first metallic portion of the outer body portion in a direction substantially parallel to the longitudinal axis with ceramic material being located between the first metallic portions to act as a first rf choke, and the second metallic portion of the inner body portion being substantially co-extensive with the second metallic portion of the outer body portion in a direction substantially parallel to the longitudinal axis with ceramic material being located between the second metallic portions to act as a second rf choke, and the first and second rf chokes are located outside said vacuum envelope.

2. A tube as claimed in claim 1, wherein said first and second metallic portions are substantially cylindrical.

3. A tube as claimed in claim 1, wherein at least one of said first and second metallic portions comprises a layer of metallization on said ceramic material.

4. A tube as claimed in claim 1, wherein the first and second metallic portions extend in the direction of the longitudinal axis outwardly from said input cavity.

5. A tube as claimed in claim 4, wherein said ceramic material is in the form of a single member which is extensive between the first metallic portions and the second metallic portions.

6. A tube as claimed in claim 1, wherein said ceramic material is a cylinder coaxially arranged about said longitudinal axis.

7. A tube as claimed in claim 6, wherein said ceramic cylinder has a substantially uniform wall thickness over an entire length thereof in the direction of the longitudinal axis.

8. A tube as claimed in claim 1, wherein said ceramic material extends in the longitudinal direction a greater distance than both said first and second metallic portions.

9. A tube as claimed in claim 1, wherein said ceramic material is at least partially covered by a different electrically insulating material.

10. A tube as claimed in claim 9, wherein said different electrically insulating material comprises silicone rubber.

11. A tube as claimed in claim 9, wherein said electrically insulating material covers at least part of one or more of said first and second metallic portions.

12. A tube as claimed in claim 9, wherein the electron gun includes a cathode and an anode, and said electrically insulating material is present in a region between said cathode and anode of said electron gun.

13. A tube as claimed in claim 9, wherein said ceramic material is substantially cylindrical and said electrically insulating material covers inner and outer surfaces of said cylinder and an end surface thereof.

14. A tube as claimed in claims 9, wherein a surface of said electrically insulating material is undulating.

15. A tube as claimed in claim 1, wherein said inner body portion comprises two sections which are electrically separate from one another.

16. A tube as claimed in claim 1, wherein said inner body portion is electrically connected to a cathode and a grid of said electron gun.

17. A tube as claimed in claim 1, wherein said inner and outer body portions are physically joined together by said ceramic material.

18. A tube as claimed in claim 1, wherein said outer body portion is maintained at substantially ground potential.

19. A tube as claimed in claim 1, wherein the electron gun includes an electrode and the tube further includes an electrical lead which is extensive through a part of said inner body portion to said electrode.

20. A tube as claimed in claim 1, wherein the ceramic material is extensive across the input cavity between the first and second rf chokes.

* * * * *